US012209418B2

(12) United States Patent
Name Sierra

(10) Patent No.: US 12,209,418 B2
(45) Date of Patent: Jan. 28, 2025

(54) REINFORCED PEDESTAL AND RETICULAR STRUCTURE THAT SUPPORTS SUPERPOSED SURFACES AND CONSTRUCTION METHOD THEREOF

(71) Applicant: NAFEX CONSTRUCTORA SA DE CV, Jalisco (MX)

(72) Inventor: Juan Carlos Name Sierra, Zapopan (MX)

(73) Assignee: NAFEX CONSTRUCTORA SA DE CV, Guadalajara (MX)

( * ) Notice: Subject to any disclaimer, the term of this patent is extended or adjusted under 35 U.S.C. 154(b) by 267 days.

(21) Appl. No.: 17/763,875

(22) PCT Filed: Sep. 27, 2019

(86) PCT No.: PCT/MX2019/000101
§ 371 (c)(1),
(2) Date: Mar. 25, 2022

(87) PCT Pub. No.: WO2021/060964
PCT Pub. Date: Apr. 1, 2021

(65) Prior Publication Data

US 2022/0349188 A1 Nov. 3, 2022

(30) Foreign Application Priority Data

Sep. 25, 2019 (MX) ..... MX/a/2019/011425

(51) Int. Cl.
*E04F 15/024* (2006.01)
*E04F 13/074* (2006.01)

(52) U.S. Cl.
CPC ..... *E04F 15/02494* (2013.01); *E04F 13/074* (2013.01); *E04F 15/02447* (2013.01)

(58) Field of Classification Search
CPC ..... E04F 15/02494; E04F 13/074; E04F 15/02447
(Continued)

(56) References Cited

U.S. PATENT DOCUMENTS 5,675,950 A * 10/1997 Schilham ..... H02G 3/385 52/510
5,713,168 A * 2/1998 Schilham ..... H02G 3/285 174/488
2005/0076590 A1* 4/2005 Wang ..... H02G 3/385 52/263

FOREIGN PATENT DOCUMENTS

WO WO-9506793 A1 * 3/1995 ..... E04F 15/02452
WO WO-2013117824 A1 * 8/2013 ..... E04B 1/76

* cited by examiner

*Primary Examiner* — Brent W Herring
(74) *Attorney, Agent, or Firm* — Michael D. Eisenberg

(57) ABSTRACT

Reinforced pedestal (A) to support raised surfaces or overlying on fixed surfaces, comprising: an internal part (1), made up of a truncated conical tubular body (2); and at its wide end a base (7) is provided; and a reinforced external tubular part (9) that houses the internal part (1), made up of a truncated conical tubular body (10), in whose center it has a longitudinally truncated conical gap to house the truncated conical body (2) of the internal part (1).

Grid structure to support overlapping surfaces, comprising: at least two reinforced pedestals (A) placed apart and parallel to each other, at a sufficient distance to support an overlapping surface; and at least two guide crossheads (13) useful for guiding the placement of the pieces (14) that are going to shape to the overlying surface.

Method for building the grid structure, comprising: at least, two modules (B) and/or (C) that form the reinforced pedestals (A); assembling the pieces (1 and 9) of a module with the pieces (1 and 9) of other modules; and to include at least
(Continued)

two guide crossheads (13) useful in placing the pieces (14) that are going to conform to the overlying surface on a fixed surface.

27 Claims, 17 Drawing Sheets

(58) Field of Classification Search
USPC ..... 52/506.06, 220.1, 220.3, 263
See application file for complete search history.

REINFORCED PEDESTAL AND RETICULAR STRUCTURE THAT SUPPORTS SUPERPOSED SURFACES AND CONSTRUCTION METHOD THEREOF

TECHNICAL FIELD OF THE INVENTION

The present invention is related to the technical fields of Mechanics and Construction; for it provides a reinforced pedestal, a grid structure shaped by the reinforced pedestals to support and hold overlapping surfaces in fixed surfaces; and likewise provides methods for the construction of the aforementioned reticulated structure.

BACKGROUND OF THE INVENTION

The pedestals to support surfaces or false floors currently have the deficiencies that they do not support greater weights and have little height so that the gap left between the firm surface and the false surface is very small. As a result, the pipes of larger diameters do not fit, and only cables or thin tubes can be laid down in-between.

Patent document US2015/0007508 (A1) was considered the closest state of the art, because it refers to an insulation panel, more specifically a support base 100 of the insulation panel type, which comprises a series of pedestals 103, which in turn have an upper surface 103 suitable for placing a floor panel. The continuous surface 101 and the pedestals 103 are manufactured in one piece with a single process from at least one thermal insulating material. Between the pedestals and on the substantially continuous surface 101 cables, hoses or installation tubes can be pulled. Said insulation panel 100 also comprises corresponding gaps and openings required by the possible fastening elements. An optional support base 200 is shown in FIG. 2, which differs from the support base 100 of FIG. 1 as in addition to the pedestals 103, the support base 200 also comprises pedestals 203, which have a slot 210 on its vertical surface, and slots 211 and 212 on its upper surface. Some pedestals 103 and 203 are provided with a hole 280 for fixing pins, and with a hole 105 for an insert 102, which comprises a stem 107, sealing discs 291, 292, 293, 294 and a head 104 having an opening through which a clamping screw or bolt passes, which can be engaged, for example, with a nut slider having a chuck, such as for a screwdriver or Allen key. A substantially continuous surface 101 may be configured to include edges and tabs or other edge features capable of sealing the joints between support bases 100 and 200; Some examples of tongue and groove features are described in FIGS. 9, 10 and 21. FIG. 3 shows an alternative embodiment of the insulation panel 300, with a pedestal 303 to which a panel 305 is placed, whose material has a different friction coefficient than the material of the pedestal 303; In order to firmly place the panel 305 on the pedestal 303, the pedestal 303 includes a gap 304 in order to be placed.

In FIG. 5 of document US2015/0007508 a raised floor system 500 is illustrated, which is constructed by joining each of the insulation panel or support foundations 100 as shown in FIG. 1, the pedestals 103 at its corners are replaced with pedestals 411, 412, 413, 414. The insulation panels 100 modified in this way are first joined together. Finally, at least one panel-type component 530 is attached via a hole 531 to the bonded insulation panels to make a raised floor system. The insulation panels are preferably joined together on both the top and bottom sides using, for example, a molded article 1400 on the top side (FIG. 14) and a molded article 1300 (FIG. 13) on the bottom side. The molded article 1300 comprises fastening edges 511 provided with a hole 516, and reinforcement arms 512 between the joining edges 511. The panel 530 can be attached, for example, by placing screws 510 in alignment with the fastening edges 511 of the molded article 1400; at the same time, the molded articles 1300 and 1400 are fastened together and to those insulation panels, through the pedestal 411, 412, 413, 414, from which the screw 510 passes. Therefore, the insulation panels used are locked together by the molded articles 1300, 1400 to a limited extent. As is apparent from FIG. 13, it would suffice for the lower molded article 1300 to be provided with a threaded hole 518. The hole 516 in the upper molded article 1400 may be a larger unthreaded hole for an easy and fast installation. Illustrated in FIG. 6 is one way of implementing a raised floor 600 with a different arrangement than that shown in FIG. 5 for joining insulation boards together.

FIG. 17 of said document US2015/0007508 shows the fixing of insulation panels by means of reinforcing features, such as bars 1710, 1701 to reinforce the insulation panels. The bars 1710, 1701 are more preferably fixed with screws 510 by fastening them to an insert or simply to a hole 105 present in the insulation panel. Preferably, the hole 105 is in this case located in the slot 211, 212 so that the bar 1701, 1710 does not rise out of the plane of an insulation panel. According to another example, the insulation panel may also comprise a reinforcing feature 1710, 1701, which functions as a mounting element that facilitates the mounting of an insulation panel, or a system made so, with various features and equipment such as partitions, doors, electrical and lighting solutions, HVAC devices, as well as other accessories. The mounting element can be, for example, a molded structure, a casting or a profile, and can be in contact with the molded structures of an insulation board and/or with the insulation board, or it can be fixed on the inserts or holes present in the insulation board.

Document US2015/0007508 discloses a panel that has the pedestals already adhered or prefabricated, which are already fixed on one of the faces of the body of the panel; so that one of its drawbacks is that the panel has to be cut to cover smaller areas. Another drawback of said pedestals is that they do not support great weights, because they do not have an internal reinforcement, and when they are reinforced, external elements 1701 and 1710 have to be placed, which complicates their installation and manufacture, by reinforcing all the pedestals.

Furthermore, the patent document BR 102014018894 (A2) discloses a raised floor pedestal which according to its characteristics, it provides the formation of a pedestal (1) in its own specific mono-block modular structure based on the integration of a lower body base-type (2) and a male-type upper body (4) interposed by an upper base (3), to provide a very practical, safe and ergonomic way to achieve complete optimization of the support and leveling of upper plates (A) of raised floors (B) overall, in addition to a complete integration of the lower part of these upper plates (A) and, based on a pedestal (1) with great resistance, safety and versatility easily adaptable to a wide range of basic floors, raised floors (B), users and locations in general. This pedestal lacks internal and external reinforcement. In addition, due to its individual configuration, it is complicated to make an exact and fast distribution of the pedestals, when it is desired to make a network of pedestals to place a raised floor.

In other hand, patent document US2014102012 refers to a false floor, a method and a device for installing the false floor. In FIG. 2 a part of a false floor 10 is illustrated with a false floor support 2A installed according to the invention, which supports four floor panels 1. In this way the assembly of all the false floor supports 2A is allowed. 2B with little effort at the same height h M on a mounting plane E M on bare floor 3. In mounting position 30A and 30B, pedestals 23 are required which consist of material which solidifies and bonds to the Ground level. In a further installation step, the false floor supports are inserted from above at least approximately vertically into the not yet solidified pedestals 23, until the lower end of the false floor support 2 is at least approximately leveled with the mounting height h M. The false floor supports 2 are each supported on a related pedestal 23, until this pedestal 23 has hardened, after which the clamping device 99 is removed. The false floor supports 2, which are preferably made of metal or plastic, may have a simple design and comprise in the embodiment shown a tubular foot member 22 and a head member 21 in the form of a head plate. The raised floor support 2 does not require an adjustment device; although only in the preferred embodiments two false floor supports which are adjustable are provided. The length or height supported by the false floor supports 2 corresponds to the difference between the height h M of at least one mounting plane EM and the height h DB of the false floor 10 (the height h DB is measured on the lower side of the floor panel 1).

FIG. 3 of document US2014102012 details a preferred option to create the pedestals 23; where a structural member 300 is provided at each mounting position 30A, 30B, and 30C, and is filled with the pedestal material 2300 that is used to create the pedestals 23, such as a concrete mix, concrete for floors, a cement mix or a cast. The structural element 300 comprises the shape of a conical tube, through which the pedestal material 2300 is transferred to the floor 3 so that it is held laterally and pedestals 23 in the form of a cake are obtained. After the hardening of the pedestal 23, the structural elements 300 are removed and reused (see FIG. 6).

In FIGS. 7a, 7b and 7c, of said document US2014102012, modalities of the false floor 10 are shown with a plurality of false floor supports 2, in two parts, each comprising a foot member 22 supported on a common pedestal 230 and a head member 21 serving to hold the floor panels 1. A two-part false floor support 2 with two tubes is shown in FIG. 7a with a head member 21 and a foot member 22 insertable one in the other. Illustrated in FIG. 7b is a one-part false floor support 2 comprising a foot member 22 in the form of a rectangular tube and a head member 21 in the form of a plate. The rectangular tube allows safe mounting of the floor panels 1 even with a small cross section. In 7c it shows in a three-dimensional view the false floor supports 2 which are simple round tubes. It can be seen that these pedestals for the construction of false floors are made to be fixed with cement or other similar material.

In an effort to counteract the aforementioned drawbacks, a reinforced pedestal was developed, a grid structure made up of reinforced pedestals, to support and/or hold surfaces overlying on fixed surfaces; and also provides methods for the construction of the aforementioned crosslinked structure; whose characteristics and technical advantages are illustrated in the following detailed description of some of its preferred embodiments, where examples and figures are included, in an illustrative and non-limiting manner for the scope of the spirit of the present invention.

DETAILED DESCRIPTION OF THE INVENTION

Reinforced Pedestal (A)

Figure 1:
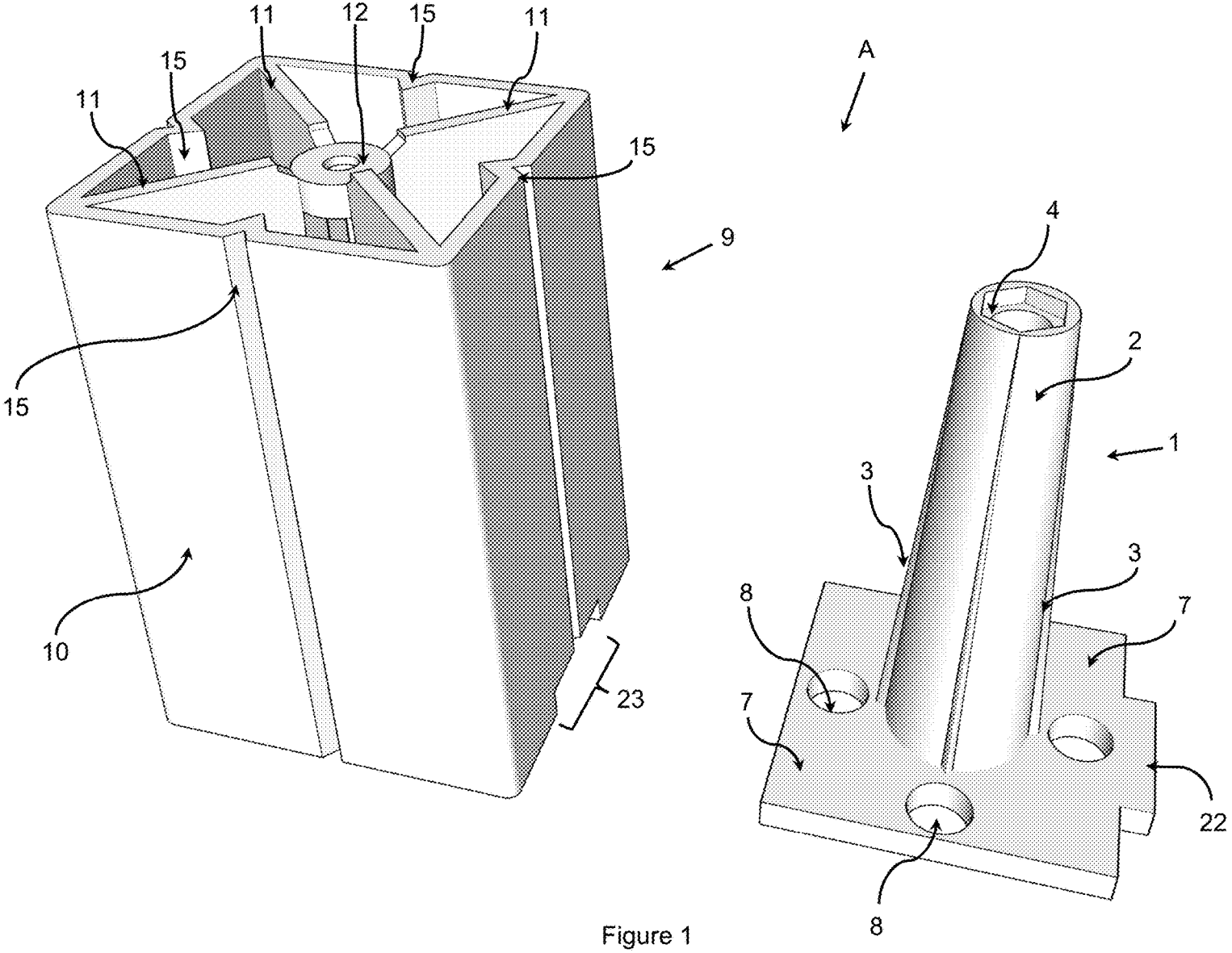
FIG. 1 is a conventional perspective view of reinforced pedestal components for supporting overlying surfaces on a fixed surface, in accordance with the present invention.
Figure 2:
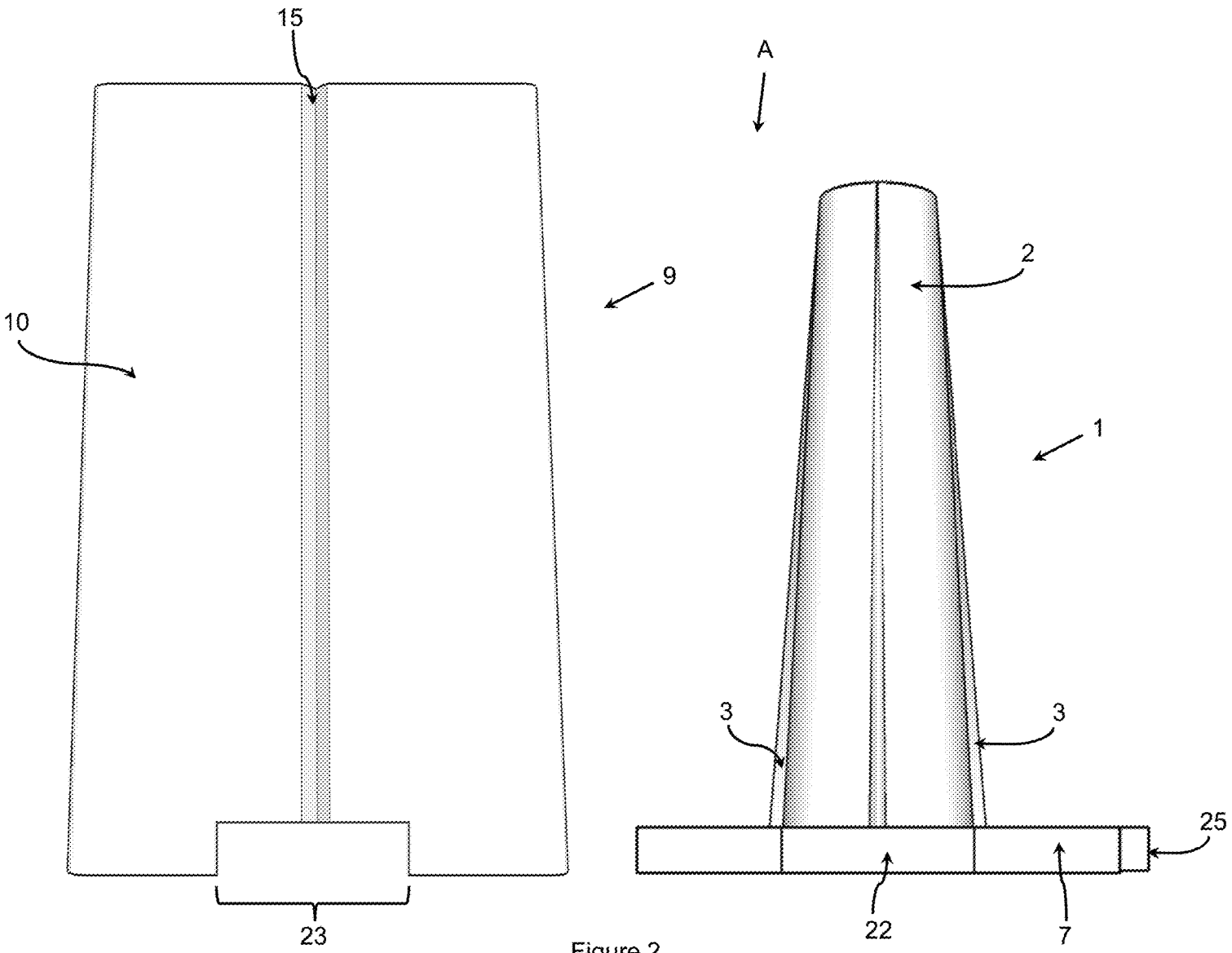
FIG. 2 is a side view of the components of the reinforced pedestal for supporting overlying surfaces on a fixed surface, of the said invention.
Figure 3:
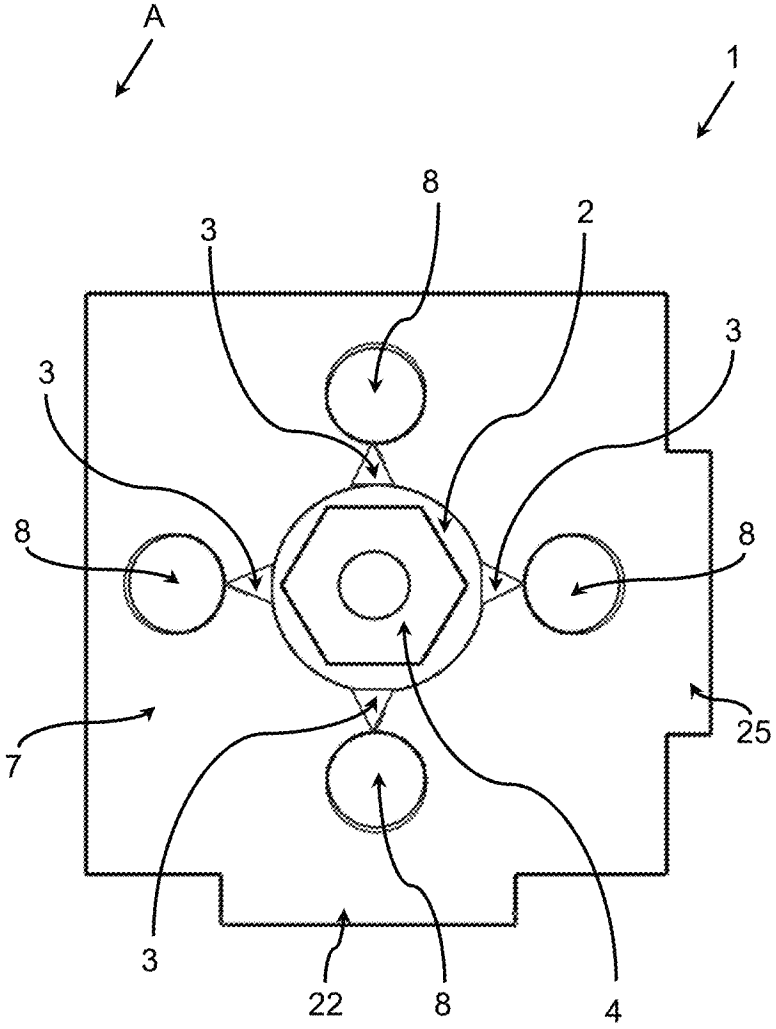
FIG. 3 is a top view of the components of the reinforced pedestal to support overlying surfaces on a fixed surface.
Figure 3:
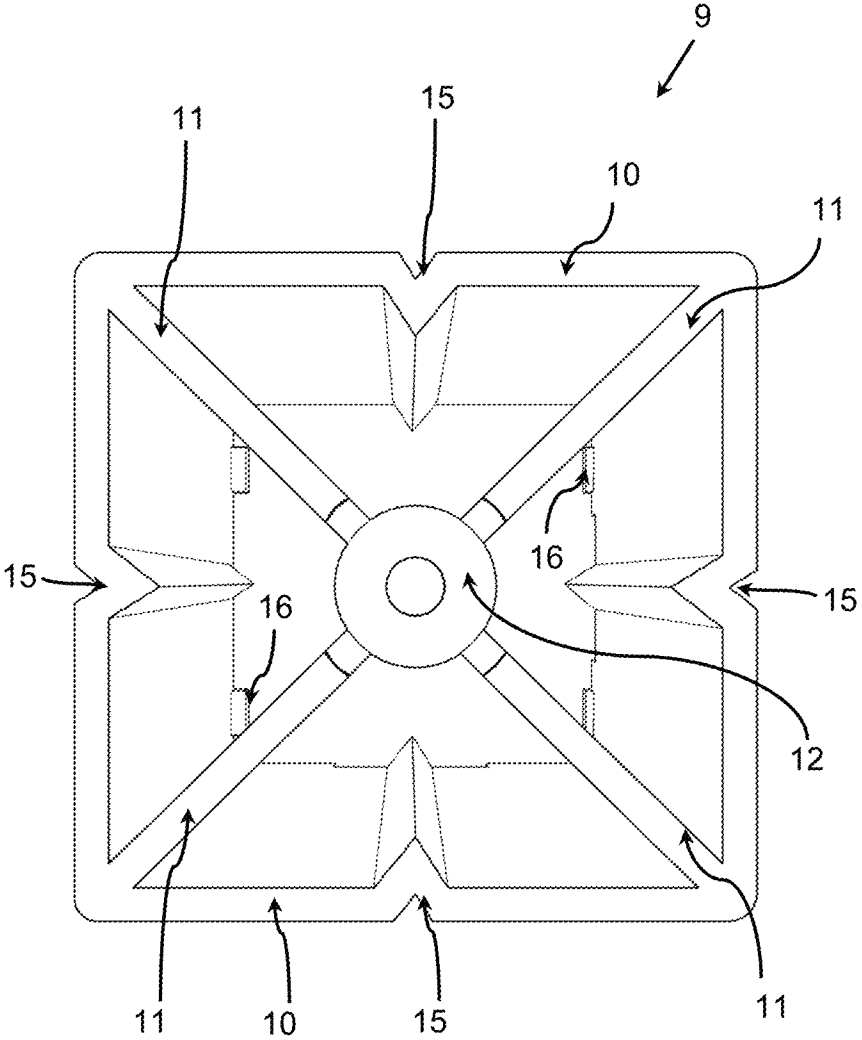
Figure 4:
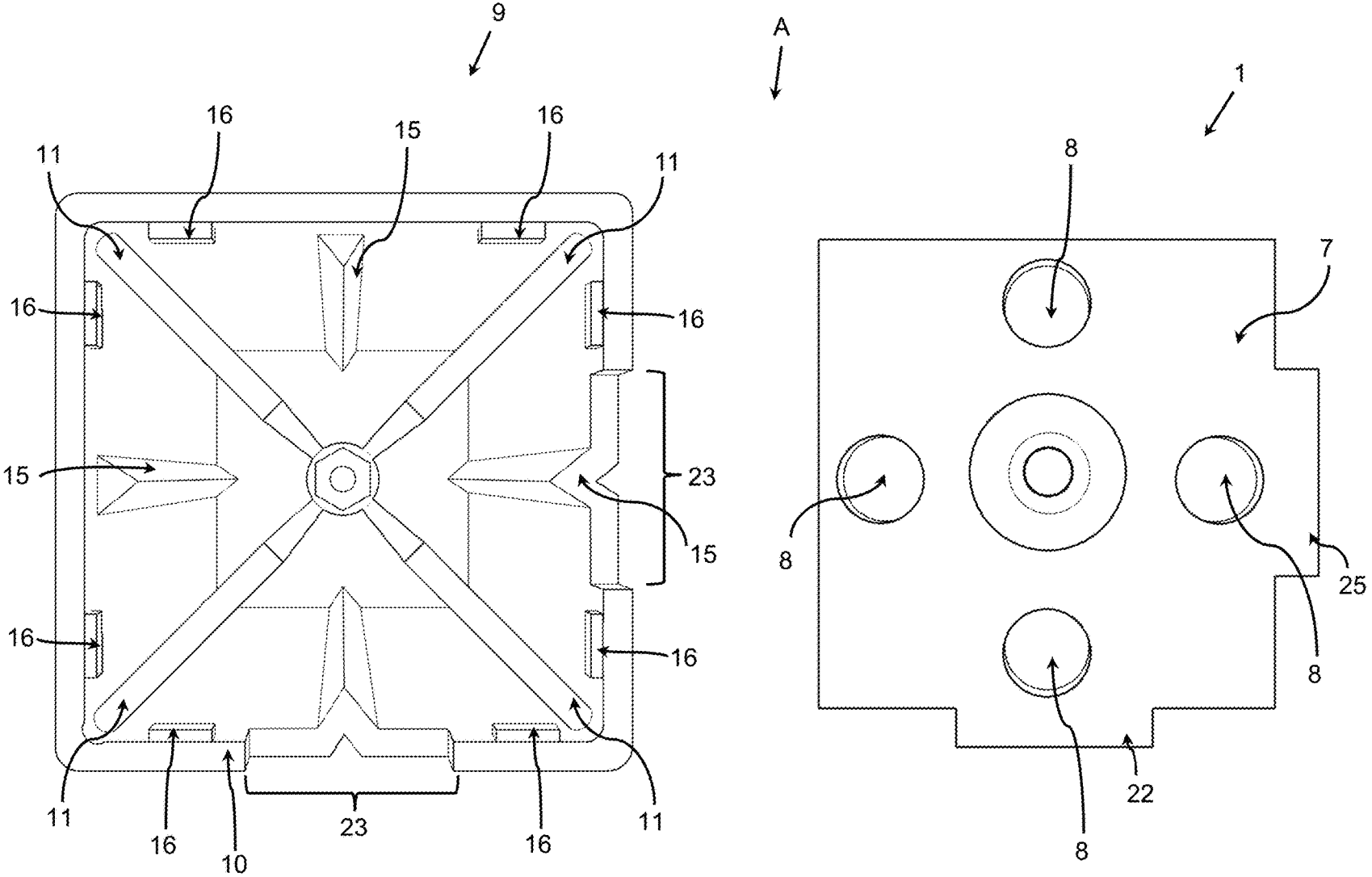
FIG. 4 is a bottom view of the components of said reinforced pedestal.
Figure 5:
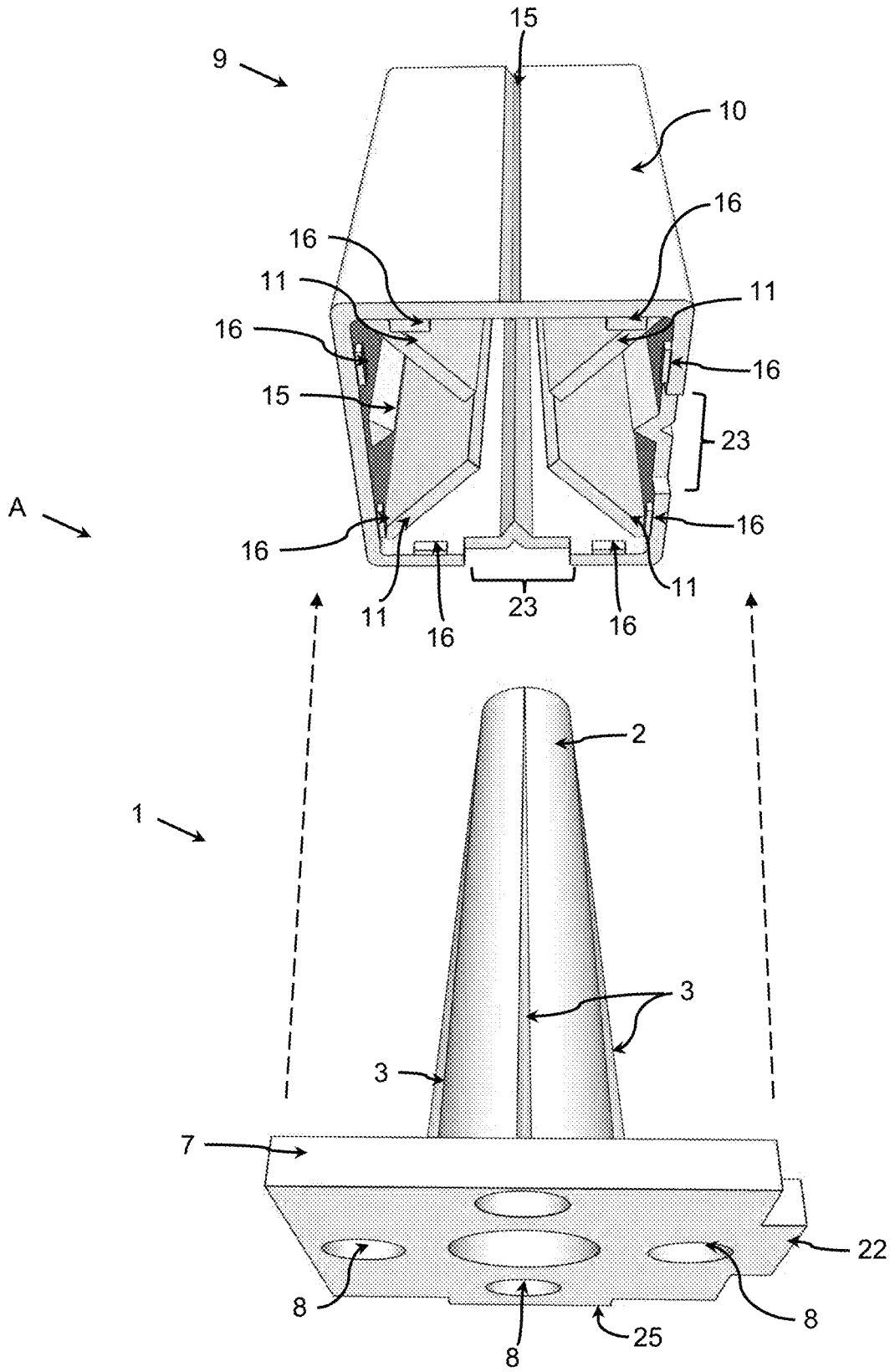
FIG. 5 is an exploded perspective view of the components of the pedestal of the present invention, where the coupling direction between them is observed.

At first instance, the present invention has for purpose a reinforced pedestal (A) to support raised surfaces or overlying on fixed surfaces; where the gap that remains between the raised or overlying surface and the fixed surface, ducts, conduits, cables, pipes, hoses, etc., are housed for services or other purposes. Raised or overlapping surfaces can be what are commonly called: "false floors", "false walls", "false ceilings", to name a few examples.

According to FIGS. 1 to 8, said reinforced pedestal (A), according to the present invention, comprises: an internal part (1), where one of its embodiments is made up of a truncated conical tubular body (2), which in turn comprises externally and longitudinally, at least one rib (3), to have a greater weight resistance; optionally, at its narrow or upper end, it is provided with a perforated cavity (4), where a fastening element (5) can be housed to fasten a screw (6);

and at its wide or lower end, it is fixed to a base (7), which in turn may optionally comprise at least one perforation (8) for when it is desired to fix the pedestal (A) on a fixed surface; where the fixing instrument can be any that is compatible with the perforation (8), such as glues, cements, adhesives, screws, tacks, nails, etc. (not illustrated).

With the truncated conical shape of the internal part (1) it is possible to obtain a resistance to weight; and by adding the external ribs (3) it is possible to further increase the resistance to weight of said internal part (1).

Figure 8:
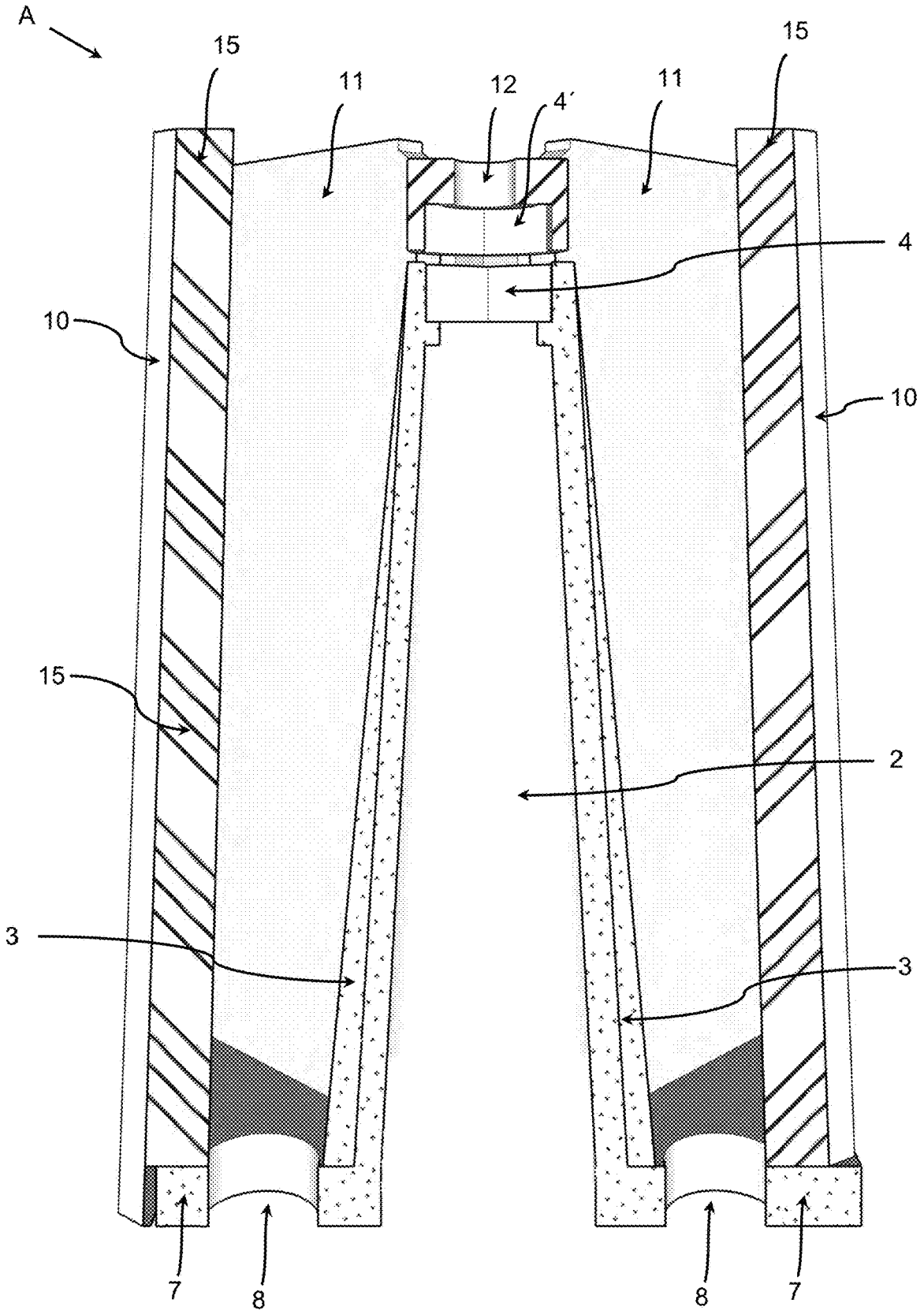
FIG. 8 is a longitudinal section a-a' of the reinforced pedestal, of the said invention, in an assembled condition.
Figure 14:
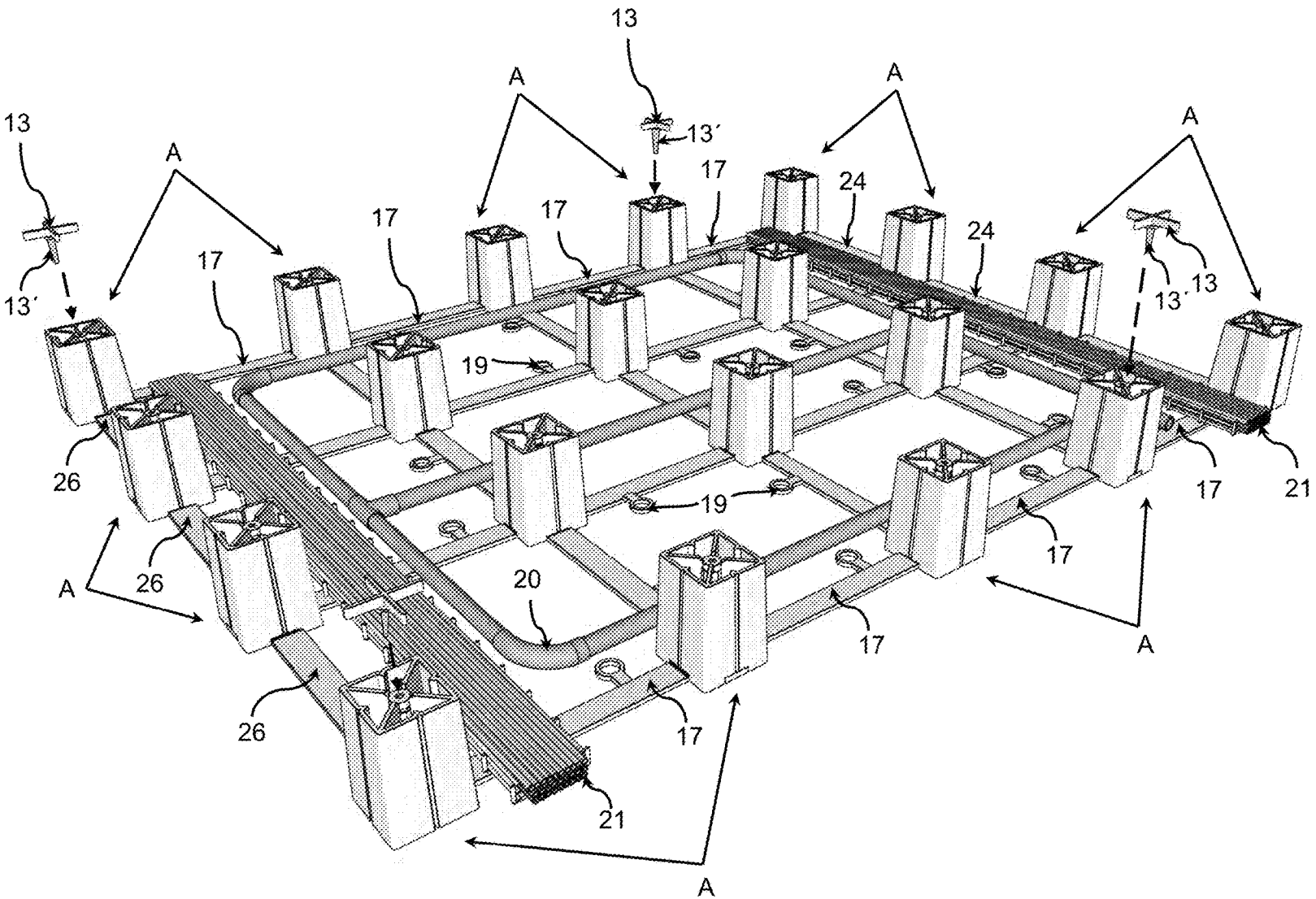
FIG. 14 is a conventional perspective view of the grid structure of the previous figure, where the placement of some crossheads is observed.
Figure 15:
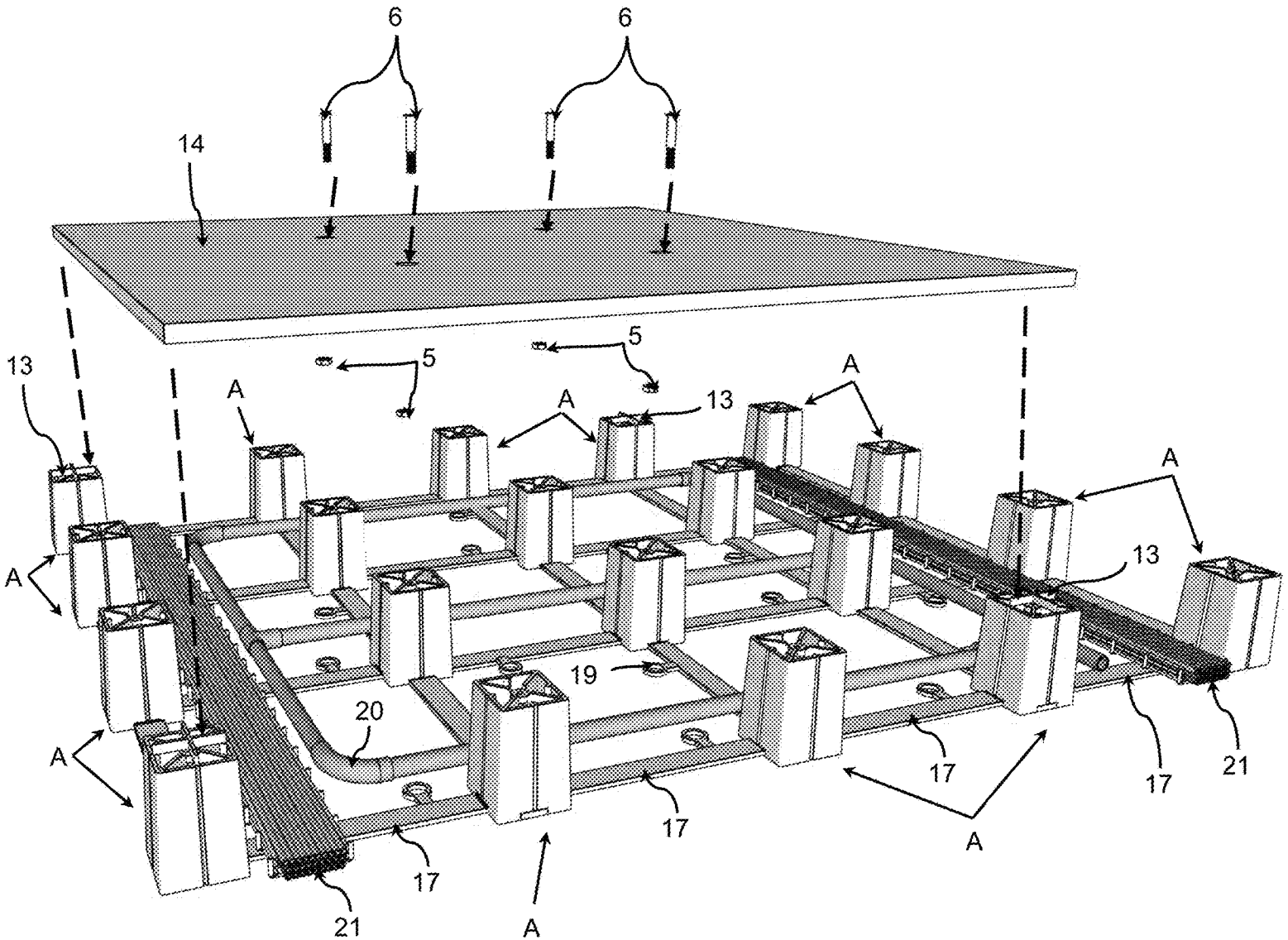
FIG. 15 is a conventional perspective view of the grid structure to support raised surfaces, according to the present invention, where the placement of a laminar piece that will give rise to a raised or overlying surface is observed.
Figure 16:
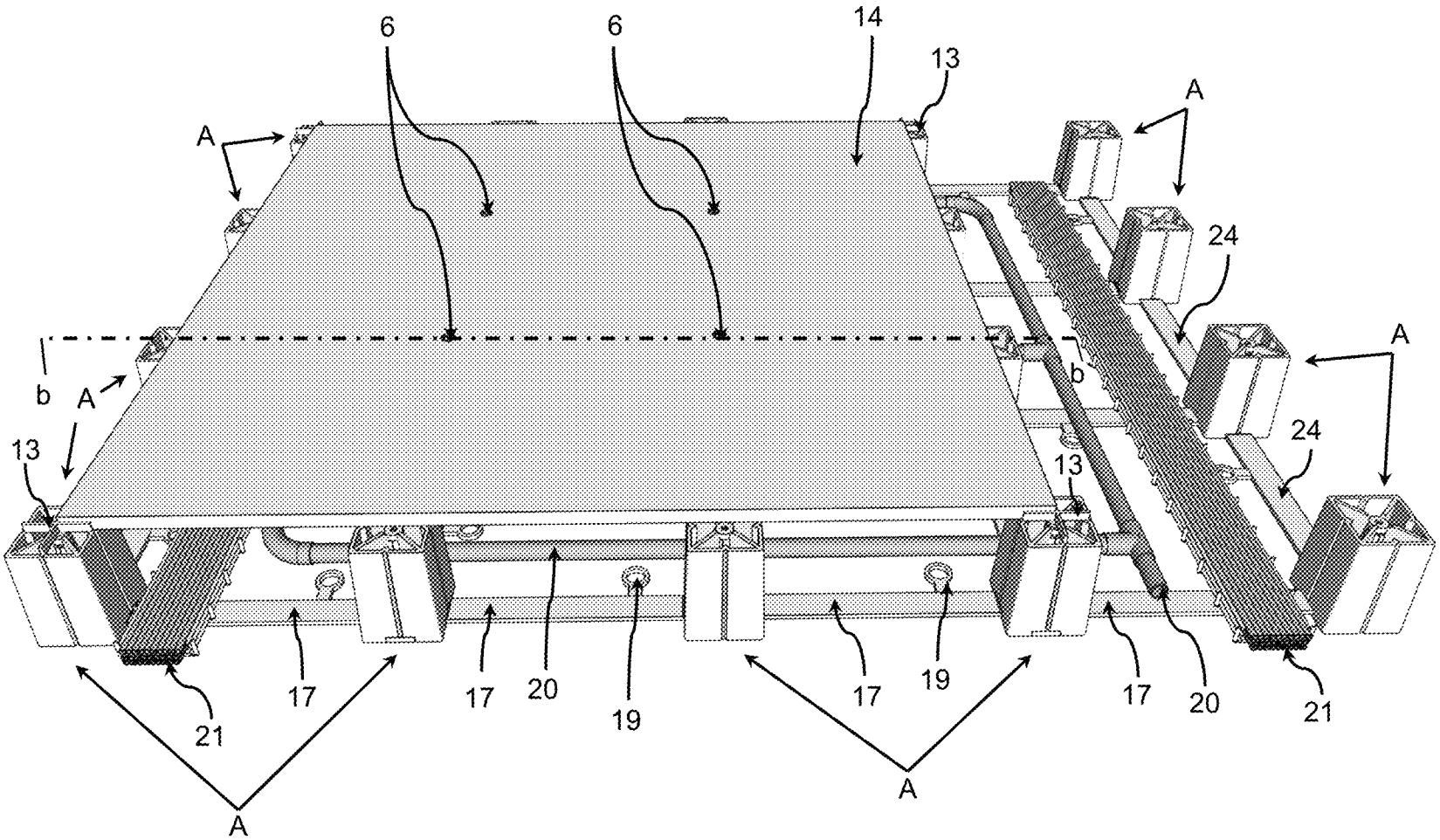
FIG. 16 is a conventional perspective view of the grid structure of the previous figure, with the piece that will give rise to the raised or overlying surface, placed on said grid structure.

Said improved pedestal (A) also comprises an external tubular part (9) that houses the internal part (1); where one of the embodiments of the external tubular part (9) is made up of a truncated conical tubular body (10) opened at both ends, in whose center has a longitudinally truncated conical space to house the truncated conical body (2) of the internal part (1), see FIG. 8; said truncated conical space is delimited by: at least two internal radial walls (11) originated diametrically opposite of each other from the internal wall of the tubular body (10) and are thrown towards the central longitudinal axis of said tubular body (10), so that the width of the internal radial walls (11) is such that leaves a gap with the shape and dimensions sufficient for the truncated tubular body (2) to be completely housed; and the truncated conical space is also delimited by a ring (12) supported by the free edges of the internal radial walls (11) located towards the center of the narrow or upper end of the truncated conical body (10), but optionally, at a position such that it leaves a sufficient upper space where a guide crosshead (13) can be inserted when a surface (14) is placed, see FIGS. 14 and 15. In the lower part of said ring (12) there is also a perforated cavity (4') equal to the cavity (4) of the narrow end of the tubular body (2), both cavities (4 and 4') form an enclosure to house a nut (5) or some other means of fastening screws (6), see FIG. 8.

In the external walls of the truncated conical tubular body (10) of the external tubular part (9), there are at least two longitudinal groves provided (15) diametrically opposite each other, which are thrown towards the interior of the tubular body (10). going longitudinally along the inner wall of said tubular body (10); such longitudinal grooves (15) serve as reinforcements to give more weight resistance to the external walls of the tubular body (10), because as the height of the walls of the tubular body (10) increases, the resistance decreases.

Figure 7:
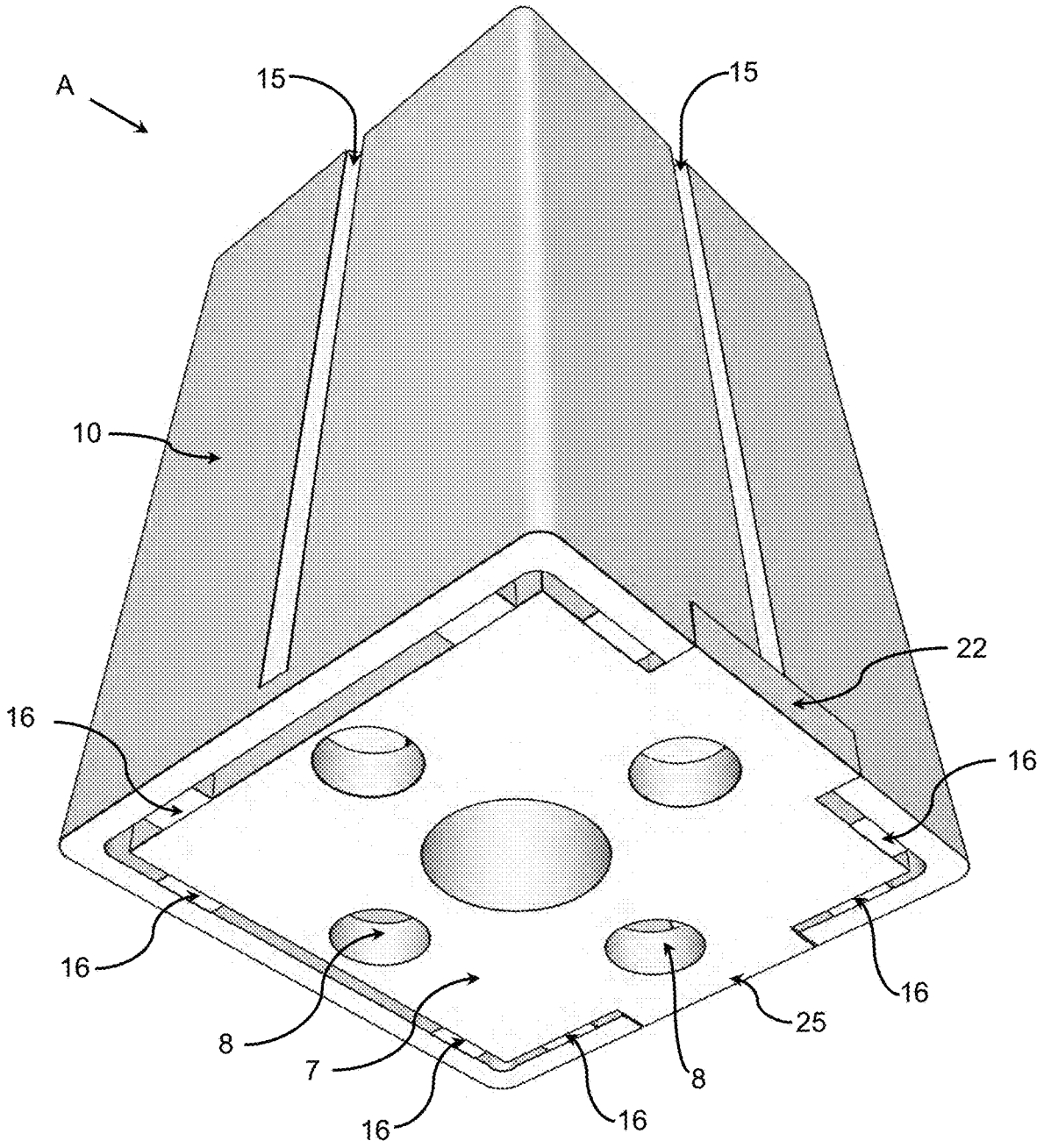
FIG. 7 is a conventional lower perspective view of said reinforced pedestal, in an assembled condition.

Furthermore, in order to internally secure said base (7) to the external walls of the tubular body (10), on the internal lower edge of the external walls, some edges (16) are strategically provided that are thrown towards the interior of the tubular body (10), in such manner that the base (7) is perpendicular in relation to the external walls, fixed by said edges (16), and thus the entire internal tubular part (1) is also firm inside the tubular part (9), see FIG. 7, where it can be seen that this base (7) serves as a cover for the wide or lower opening of the external tubular part (9).

Just as the internal part (1), the external tubular part (9), by having a truncated conical shape, acquires a level of resistance to weight and when the grooves (15) are added, the resistance to weight increases.

Figure 6:
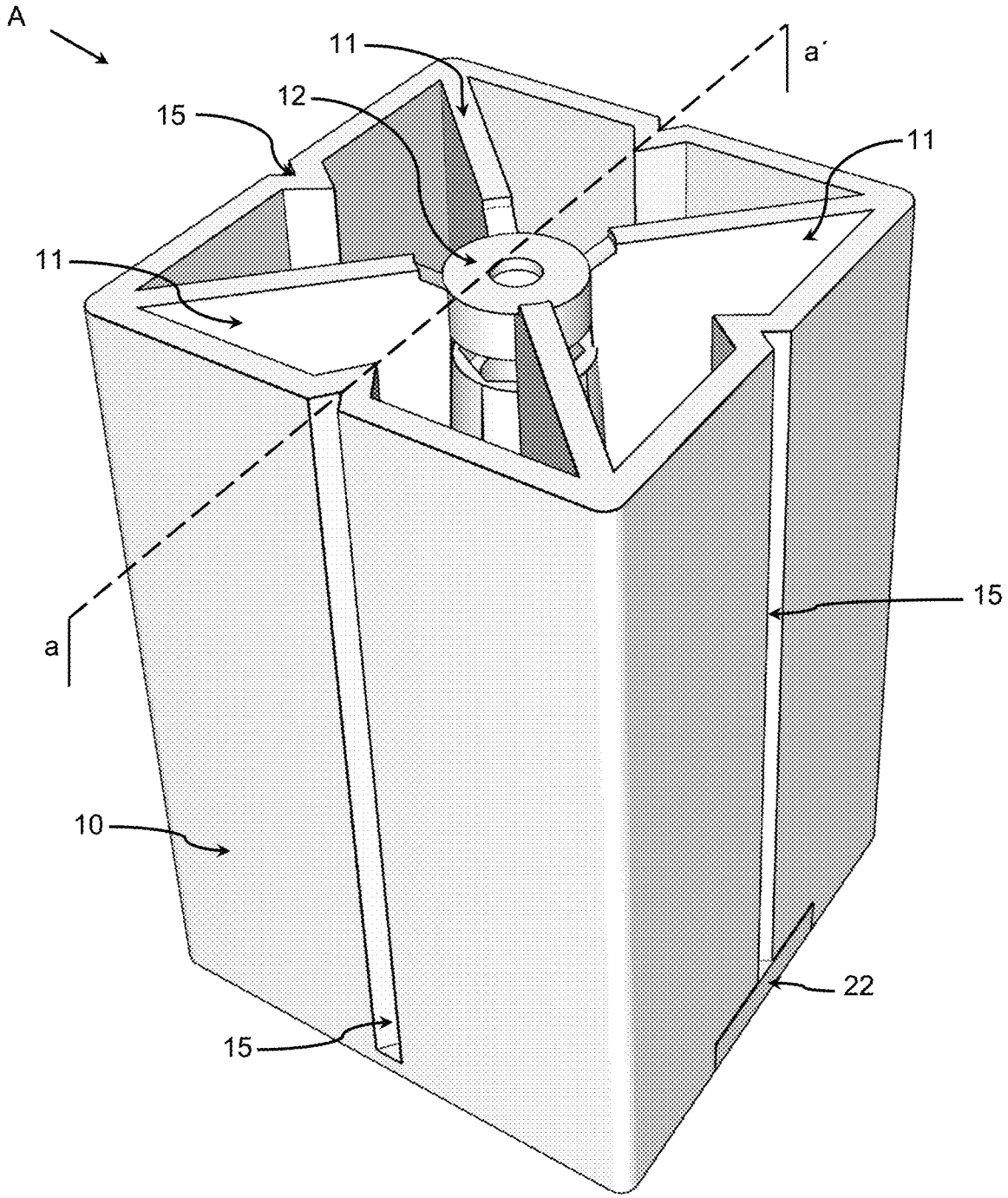
FIG. 6 is a top conventional perspective view of the reinforced pedestal, in an assembled condition.
Figure 17:
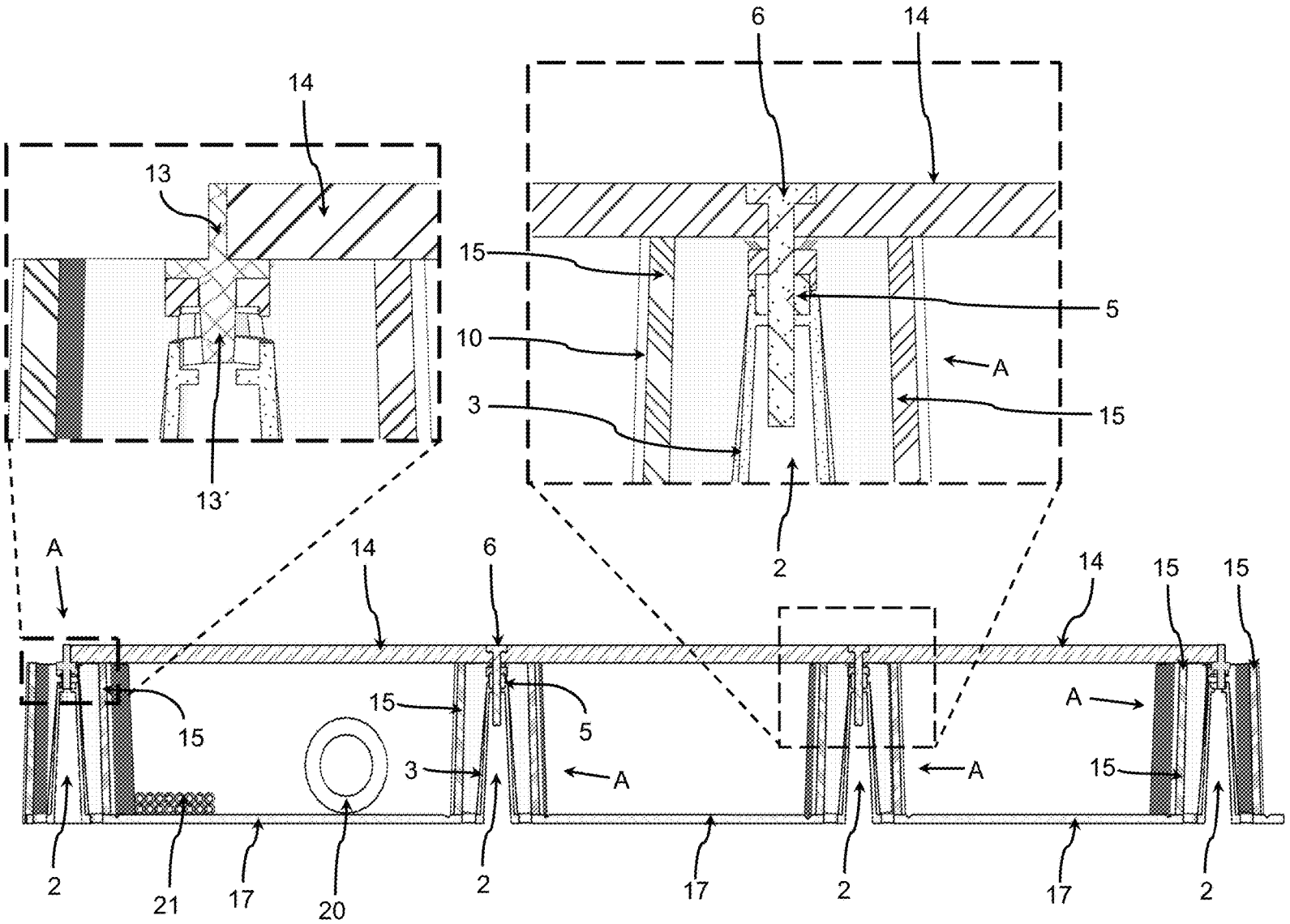
FIG. 17 is a section b-b', of the previous figure, and a close-up to see in detail the arrangement of the fastening elements of the piece that will give rise to the raised or overlying surface.

The way to integrate the improved pedestal (A), to support raised or overlying surfaces, according to the present invention, is to insert the truncated conical tubular body (2), of the internal part (1), through the lower part of the external tubular part (9), being housed in the truncated conical space of said external tubular part (9), and pressing the base (7) of said internal part (1) until the edges (16) trap the base (7), see FIGS. 6, 7, and 8. It should be noted that when the truncated conical tubular body (2) includes the perforated cavity (4), this remains connected to the lower cavity (4') and aligned with the perforation of the ring (12), in case it is desired to insert a screw (6) with its respective fastening means (5) such as a washer, for example, as illustrated in FIG. 17.

In this manner we obtain a pedestal or reinforced support (A) to support and/or hold elevated or overlying surfaces on a fixed surface, which can support a weight of 5 to 10 tons/$m^2$, thanks to the truncated conical shapes and added reinforcements the components.

Grid Structure

One more instrument of the present invention is a grid structure to support overlying surfaces on a fixed surface, where said grid structure comprises:

i) at least two reinforced pedestals (A), such as the pedestals described above, which are placed apart and parallel to each other, at a sufficient distance to support an overlapping surface (14); and ii) at least two guide crossheads (13) useful to guide the placement of the pieces (14) that are going to shape the overlying surface on a fixed surface, where said guide crossheads (13) have a pivot (13') to be inserted into the upper space of the ring (12), passing through its lower cavity (4') to the perforated cavity (4) of the piece (1).

One modality of the grid structure of the present invention is that it also comprises at least one connector that joins in a linear plane the external reinforced tubular part (9) of a reinforced pedestal (A) with the internal reinforced part (1) of another reinforced pedestal (A). Said connector can be a longitudinal connector (17), where one of its ends is attached to a horizontal projection (22) of the base (7) of the internal part (1) and the other end is attached to the lower edge of the side that does not have an inlet (23) on the external wall of the tubular body (10). Another modality is when the connector is a first transverse connector (24) that joins the two internal parts (1) of two contiguous reinforced pedestals (A), by means of second linear edges (25) located on the sides adjacent to the sides where the first linear edges (22) of the base (7) are. The connector can also be a second transverse connector (26) that joins the two external pieces (9) of two contiguous reinforced pedestals (A), by means of their lower edges of their sides that do not have inlets (23).

Another modality of the structure according to this invention is when it also comprises at least one detachment mechanism (18) to easily separate the pieces (1 and 9) of the connector that joins them; where the detachment mechanism (18) is preferred to be placed at the junction points between the connectors (17, 24 and 26) and the edges (22, 25) of the base (7) of the internal parts (1), and/or the lower edge of the external wall of the tubular body (10) of the external parts (9). An example of the detachment mechanism (18) is a slit, and/or a weakening, or any other mechanism that allows the pieces (1, 9) to be easily detachable.

Another variant that the aforementioned structure may have, is that it may also comprises at least one fastening element (19) adhered to the connector that joins the parts (1) and (9); where the fastening element (19) is selected from the following group: rings, rings, and staples, to quote a few examples.

In order to assemble faster and efficiently the grid structure proposed by the present invention, it is proposed to manufacture the modules (B and C) forming the reinforced pedestals (A); Therefore, these modules (B and C) and all their variants that can be built are subjects of the present invention. Furthermore, a description of some embodiments of said pedestal-forming modules (B, C) is made, by way of illustrative and non-limiting examples.

Figure 9:
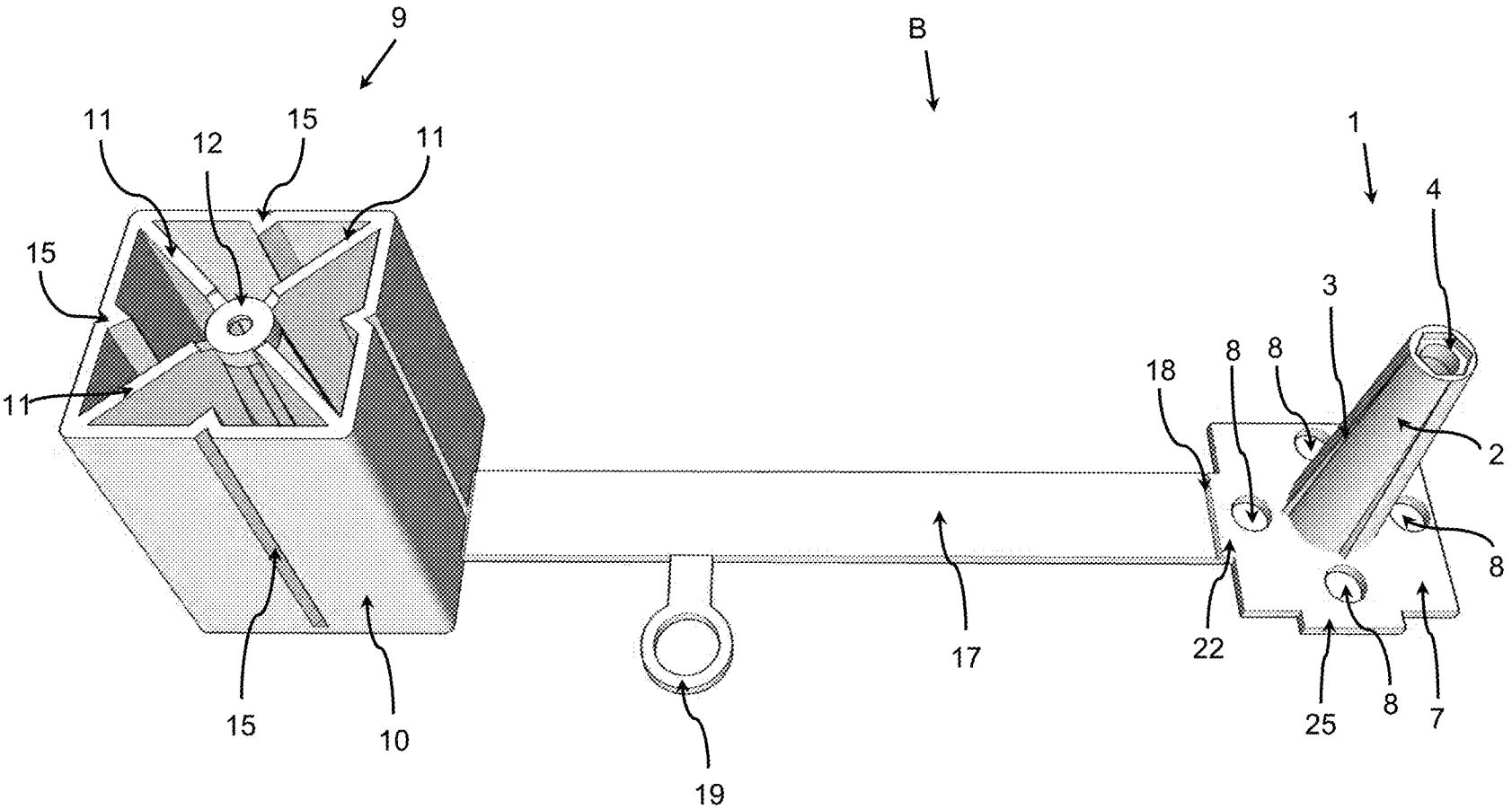
FIG. 9 is a conventional perspective view of a simple module (B) forming reinforced pedestals, according to the said invention.

FIG. 9 illustrates a first embodiment of a simple module (B) to form the reinforced pedestals (A); where said simple module (B) is made up of an internal part (1) and an external tubular part (9), both as described in this invention; but with the difference that the internal part (1) has at least one horizontal edge (22, 25) in at least one of the sides of the base (7), and the external tubular part (9) has at its wide or lower end of the tubular body (10), at least one inlet (23) on the lower edge of at least one of the sides of the tubular body (10) so that the horizontal edge (22, 25) of the base (7) is perfectly housed in said inlet (23). As can be seen in FIG. 9, the parts (1) and (9) are not assembled together, but are joined in a linear plane by means of a longitudinal connector (17), where one of their ends is joined at the horizontal projection (22) of the base (7) of the internal part (1) and the other end is joined to the lower edge of the side that does not have an entrance (23) of the external wall of the tubular body (10). It is worth mentioning that optionally, at least one weakening mechanism (18) is provided to easily detach the pieces (1 and 9) from the longitudinal connector (17); for example, a slit or thinning can be a weakening mechanism (18), which is preferred to be located at the connection point between the longitudinal connector (17) and the edge (22) of the base (7) the internal piece (1) and/or on the external wall of the tubular body (10) of the external part (9).

Figure 10:
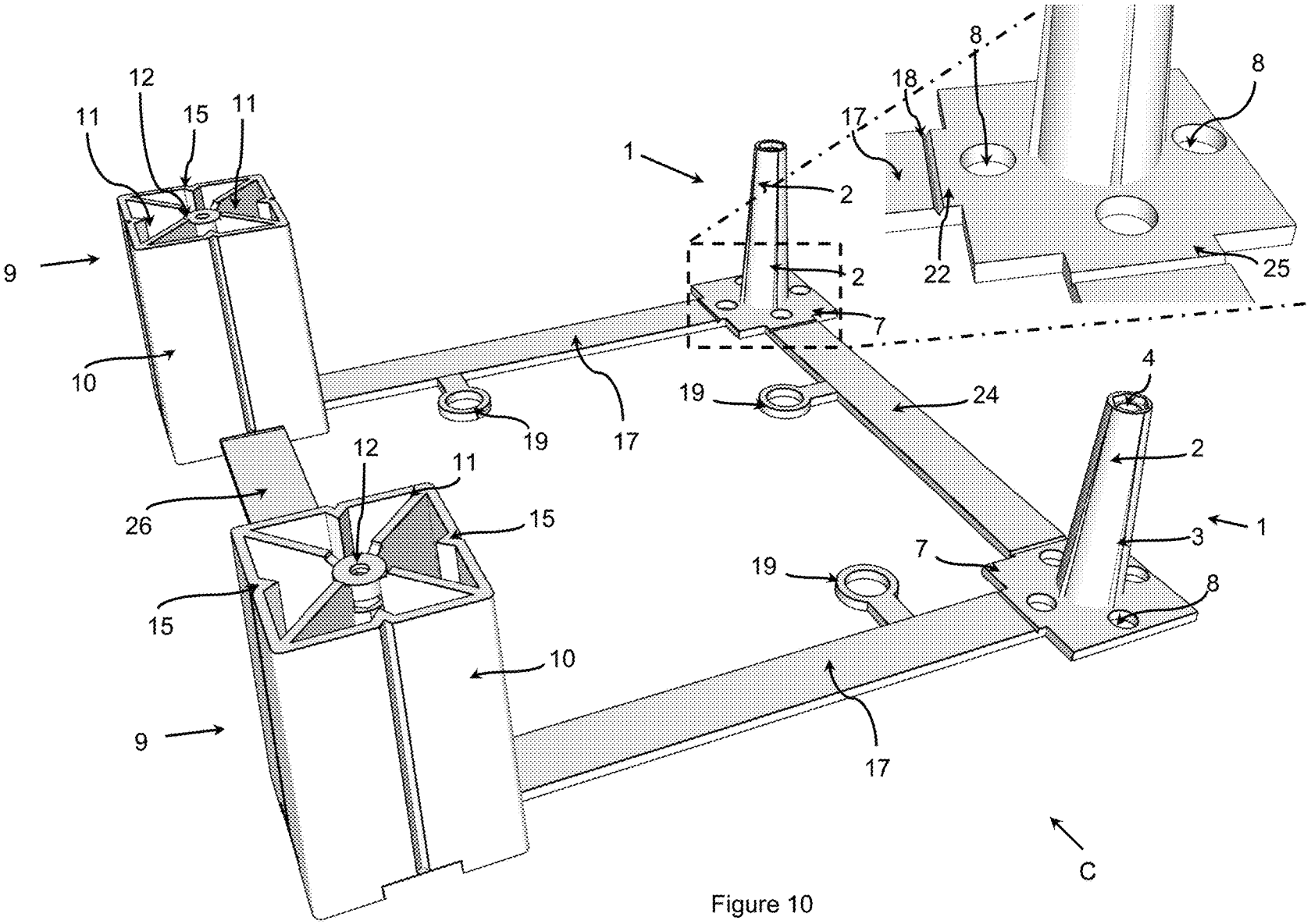
FIG. 10 is a conventional perspective view of a forming complex module (C) with reinforced pedestals according to the said invention.

Therefore, it is obvious that said simple module (B) can be made more complex by adding more internal parts (1) and external tubular parts (9), in a quadrangular, rectangular or other arrangement. Therefore, an embodiment of a complex module (C) forming pedestals (A), is as illustrated in FIG. 10, and it is when it comprises at least two simple modules (B), such as the one described above, arranged amidst each other, in a parallel way; where a first transverse connector (24) joins the two internal parts (1) by means of second linear edges (25) located on the adjacent sides of the sides where the first linear edges (22) are located and a second transverse connector (26) joins the two external pieces (9), by means of their lower edges of their sides that do not have inlets (23). As well as in the longitudinal connector (17), in the transverse connectors (24 and 26), they can also be provided with at least one weakening mechanism (18) to easily detach the pieces (1 and 9) from such transverse connectors (24 and 26); for example, a groove can be a weakening mechanism located at the connection point between said transverse connectors (24 and 26) and the lower edges of the walls of the two external pieces (9).

It is worth mentioning that, in this embodiment, it is obvious to an expert in the art that the longitudinal and transverse connectors (17, 24 and 26) can have a different arrangement, such as being crossed, including the parts (1 and 9) They could have a different distribution, as long as a perfect coupling between simple (B) and/or complex (C) modules can be carried out.

Figure 11:
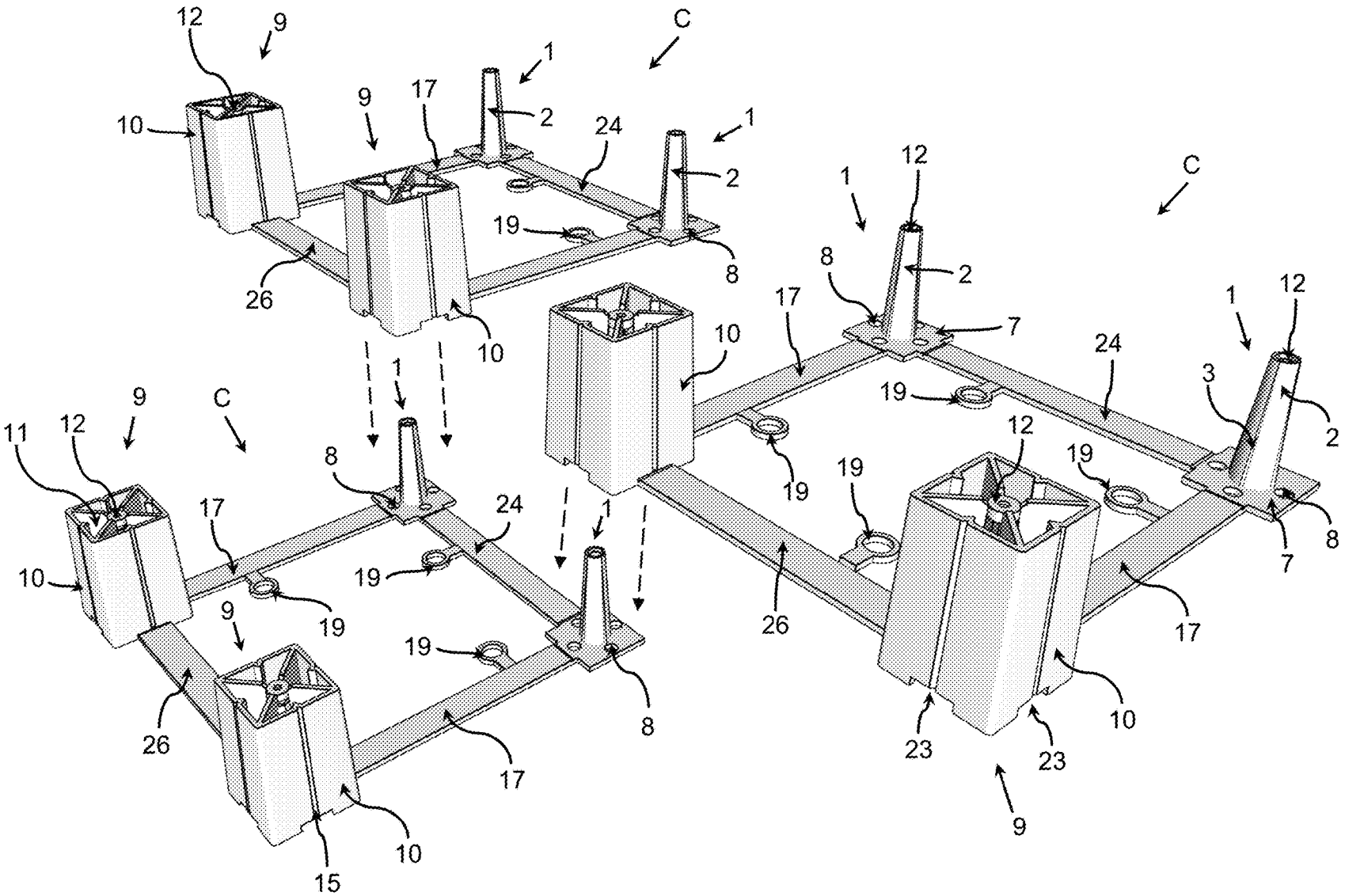
FIG. 11 is a perspective view of 3 complex modules (C), where the mode of assembly between them is observed.
Figure 12:
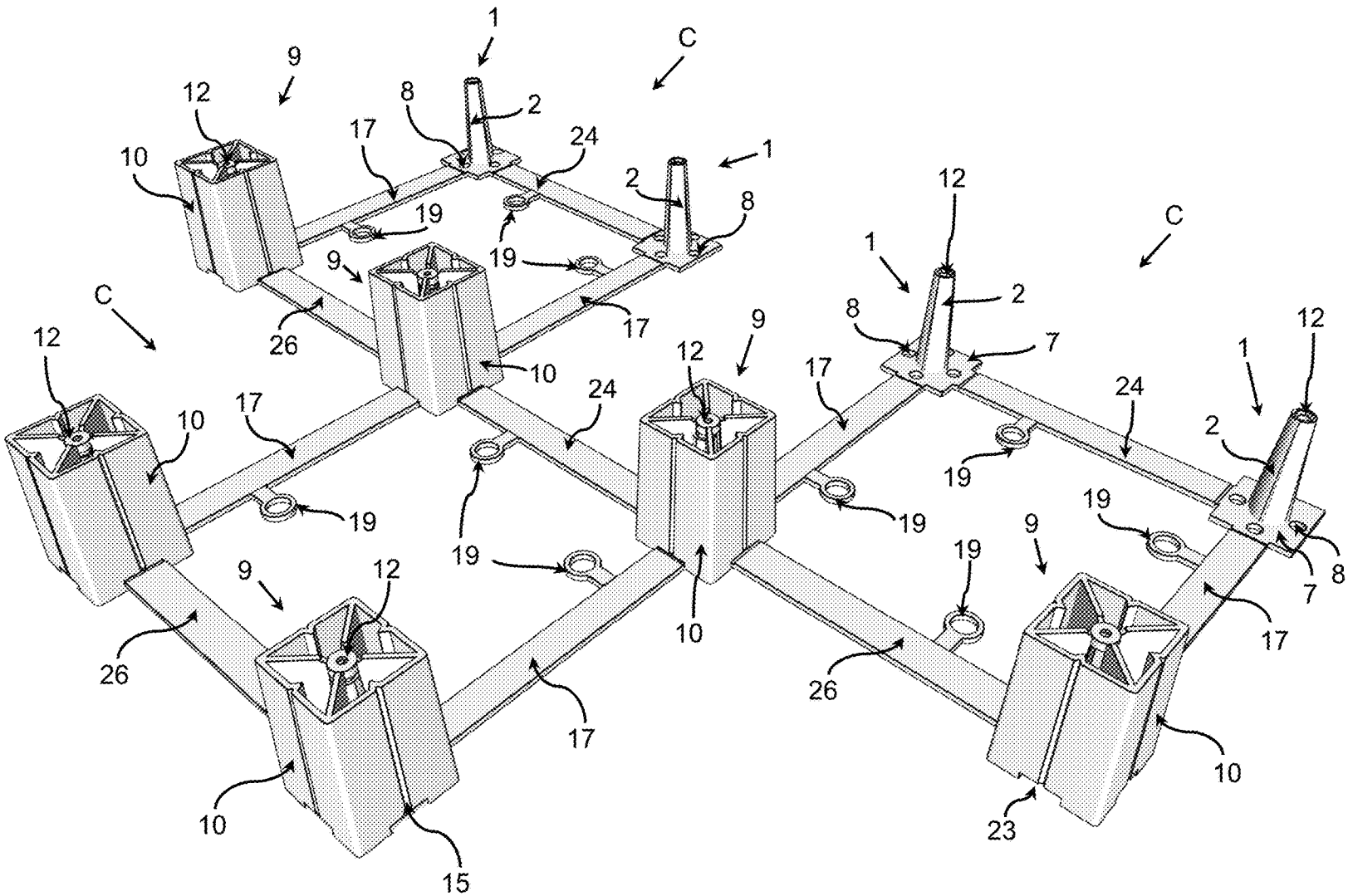
FIG. 12 is a conventional perspective view of the previous figure of the complex modules (C), in an assembled condition.
Figure 13:
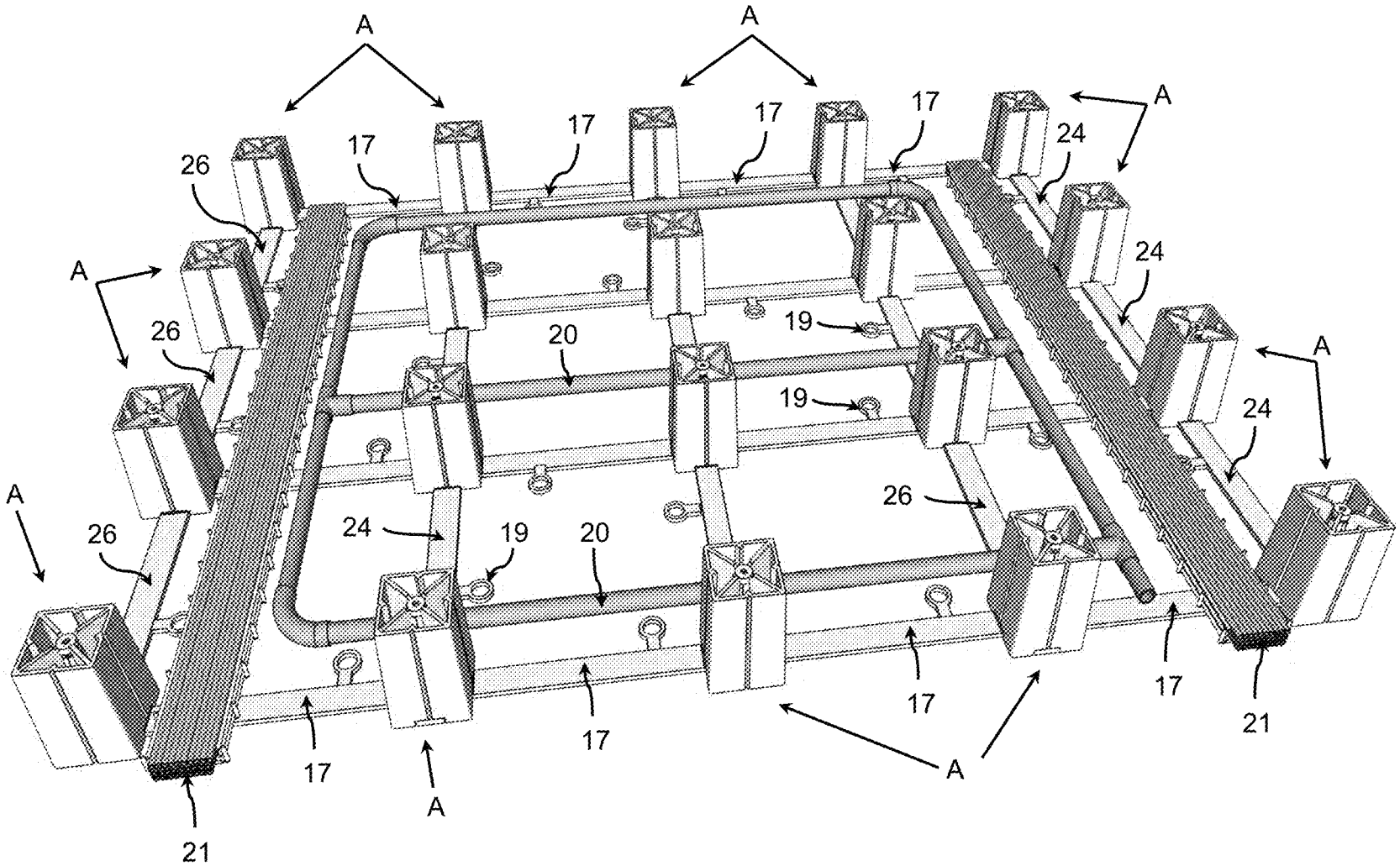
FIG. 13 is a conventional perspective view of a reticulated structure for the support of elevated surfaces, formed with modules (B and C), according to the present invention, where the placement of service facilities can be seen.

Therefore, the grid structure of the present invention can also be built with, at least, two modules (B and/or C) that form the aforementioned reinforced pedestals (A), to support raised surfaces or overlying on fixed surfaces; where the pieces (1 and 9) of a simple module (B) and/or complex module (C), are assembled with the pieces (1 and 9) of other simple modules (B) and/or complex modules (C), see FIGS. 11 and 12; even sometimes, to finish the grid structure, it is required to assemble pieces (1 or 9) independently, that is, they do not necessarily have to be a complete module, and hence the importance of placing the weakening mechanism (18) to detach a single one part, either the internal part (1) or the external tubular part (9).

In FIGS. 13 to 16, an example can be seen of a grid structure made up of the modules (B and C) that form reinforced pedestals (A), and internal parts (1) and individual external tubular parts (9), and the gaps that remain between the raised surface and the fixed surface are used to place service installations, such as pipes (20), gutters (21), cables, hoses, etc.; remaining these hidden.

To fix the pieces (14) that will give rise to the raised surface, any fastening element can be used, such as screws (6), which are inserted into the plates and pass through the ring (12) of a tubular piece (9) and the upper perforation of the truncated conical tubular body (2) of an internal part (1), and to fix it a washer (5) is provided in the cavity formed by the cavities (4 and 4') of the tubular truncated body (2). If the part (14) is hard or very resistant, previously drilling can be done for the introduction of the screw (6).

The grid structure of the present invention also has the advantage that it can be disassembled, so it can be assembled and disassembled easily and, in less time, raised or overlapping surfaces, which gives it more advantages compared to other false surface supports, which are fixed and complicated to build.

Construction Method of the Grid Structure

Therefore, another subject of the present invention is a method for building the grid structure, in accordance with the present invention, where said method comprises the following steps:

i) provide at least two modules (B) and/or (C) that form reinforced pedestals (A), where each module comprises: at least one internal part (1) with at least one horizontal edge (22, 25) on at least one of the sides of its base (7); an external tubular piece (9) that has at its wide or lower end of the tubular body (10), at least one inlet (23) in the lower edge of at least one of the sides of the tubular body (10) so that the horizontal edge (22, 25) of the base (7) is perfectly housed in said entrance (23); and at least one connector joins the internal part (1) with the external tubular part (9) in a horizontal plane;

ii) assemble the pieces (1 and 9) of a module with the pieces (1 and 9) of other modules to assemble the reinforced pedestals (A); where the internal part is inserted into the truncated conical gap of the external part (9), until the base (7) is secured by the edges (16) of said part (9), and the horizontal edges (22, 25) are coupled to their respective inlet (23) of said external tubular part (9);

iii) repeat the previous step until all the required modules (B) and/or (C) are assembled forming the pedestals (A); and iv) assembling parts (1, 9) independently in those parts (1, 9) that were not assembled, to finish the grid structure.

What is claimed is:

1. A reinforced pedestal (A) to support a raised surface, comprising:

i) an internal part (1), comprising:

a first truncated conical tubular body (2), which in turn comprises externally and longitudinally, at least, one rib (3); and a base (7) at a wide end of the tubular body; and ii) an external tubular part (9) configured to houses the internal part (1) and comprising, a second truncated conical tubular body (10) opened at both ends, which comprises:

at least two internal radial walls (11) extending radially inward from an inner wall of the tubular body (10) towards a central longitudinal axis of the tubular body (10), and delimiting a truncated conical gap to completely house the first truncated conical body (2) of the internal part (1), a ring (12) supported by free edges of the internal radial walls (11) located towards the center of a narrow end of the second truncated conical body (10), and delimiting the truncated conical gap;

at least two longitudinal slits (15) diametrically opposite each other are provided on external walls of the second truncated conical tubular body (10); and second edges (16) provided on a lower internal edge of the internal walls of the second truncated conical tubular body (10), such that the second edges (16) extend inwards in the second truncated conical tubular body (10), in such a way that they secure the base (7) to the wall of second the truncated conical tubular body (10), giving firmness to the reinforced pedestal (A).

2. The pedestal of the claim 1, wherein the internal part (1) comprises, at its narrow end, a perforated cavity (4), to house a fastening element (5) that holds a screw (6).

3. The pedestal according to claim 2, wherein the ring (12) comprises in its lower part a lower cavity (4') equal to the perforated cavity (4) of the tubular body (2) of the internal part, where the perforated cavity (4) and the lower cavity (4') form an enclosure to house the fastening element (5) that holds the screw (6).

4. The pedestal of claim 3, wherein the fastening means (5) comprises a nut.

5. The pedestal of claim 1, wherein the base (7) of the internal part (1), comprises at least one perforation (8) to introduce any fastening means to fix the internal part (1) to a fixed surface.

6. The pedestal, as claimed in claim 1, wherein the base (7) of the internal part (1) also comprises at least one horizontal edge (22, 25) on one of its sides (7).

7. The pedestal according to claim 1, wherein the ring (12) is positioned to allow insertion of a guide crosshead (13) into the ring, such that the guide crosshead, when inserted into the ring, creates a gap between the external tubular part (9) and a surface placed upon the a guide crosshead.

8. The pedestal of claim 1, wherein the external tubular part (9) has at the wide end of the tubular body (10), at least one inlet (23) on a lower edge of at least one of the sides of the tubular body (10) so that the horizontal edge (22, 25) of the base (7) is housed in the inlet (23).

9. A grid structure to support the surfaces on a fixed surface, that comprising:

i) at least two reinforced pedestals (A), in accordance with the claim 7, placed apart and parallel to each other, at a sufficient distance to support the raised surface (14); and ii) at least two guide crossheads (13) configured to guide the placement of the raised surface (14) on a fixed surface, where each of the guide crossheads (13) has a respective pivot (13') configured to be inserted into the ring (12) from above, passing through the lower cavity (4') of the ring to the perforated cavity (4) of the internal part (1).

10. The structure of claim 9, that further comprising at least one connector that joins in a linear plane the external reinforced tubular part (9) of a reinforced pedestal (A) with the internal reinforced part (1) of another reinforced pedestal (A).

11. The structure of claim 10, wherein:

the external tubular part (9) has at the wide end of the tubular body (10), at least one inlet (23) on a lower edge of at least one of the sides of the tubular body (10) so that the horizontal edge (22, 25) of the base (7) is housed in the inlet (23); and the connector is a longitudinal connector (17), where one of its ends is attached to the horizontal edge (22) of the base (7) of the internal part (1) and the other end is attached to the lower edge a side of the external wall of the tubular body (10) that does not have an inlet (23).

12. The structure of claim 10, wherein the connector is a first transverse connector (24) that joins the two internal parts (1) of two contiguous reinforced pedestals (A), by means of second linear edges (25) located on the sides adjacent to the sides where the first linear edges (22) of the base (7) are.

13. The structure according to claim 10, wherein:

the external tubular part (9) has at the wide end of the tubular body (10), at least one inlet (23) on a lower edge of at least one of the sides of the tubular body (10) so that the horizontal edge (22, 25) of the base (7) is housed in the inlet (23); and the connector is a second transverse connector (26) that joins the two external parts (9) of two contiguous reinforced pedestals (A), by means of their lower edges of their sides that do not have inlets (23).

14. The structure according to claim 9, further comprising at least one detachment mechanism (18) to easily separate the internal part and the external tubular part from the connector that joins the internal part and the external tubular part.

15. The structure according to claim 14, wherein the detachment mechanism (18) is placed at the junction points between the connectors (17, 24 and 26) and the edges (22, 25) of the base (7) of the internal parts (1), and/or the lower edge of the external wall of the tubular body (10) of the external parts (9).

16. The structure according to claim 14, wherein the detachment mechanism (18) is a slit, and/or a weakening.

17. The structure according to claim 9, further comprising at least one fastening element (19) for objects in the connector that joins the internal part and the external tubular part.

18. The structure of claim 17, wherein the fastening element (19) is selected from the following group: rings, and staples.

19. A method for building the grid structure, in accordance with claim 9, comprising:

i) providing at least two modules (B and/or C) that form the reinforced pedestals (A), where each module comprises: the at least one internal part (1) with at least one horizontal edge (22,25) on at least one of the sides of its base (7); the external tubular part (9) that has at its wide or lower end of the tubular body (10), at least one inlet (23) in the lower edge of at least one of the sides of the tubular body (10) so that the horizontal edges (22, 25) of the base (7) are housed in the inlet (23); and at least one connector joins the at least one internal part (1) with the external tubular part (9) in a horizontal plane;

ii) assembling the at least one internal part (1) and the external tubular part (9) of a module with the internal parts and the external tubular parts of other modules to assemble the reinforced pedestals (A); where the at least one internal part is inserted into the truncated conical gap of the external part (9), until the base (7) is secured by the second edges (16) of the external tubular part (9), and the horizontal edges (22, 25) they are coupled to their respective inlet (23) of the external tubular part;

iii) repeating the previous step until assembling all required modules (B and/or C) forming the required pedestals (A);

iv) assembling the at least one internal parts and the external tubular part independently of internal parts and the external tubular parts that were not assembled, to complete the grid structure; and v) including the at least two guide crossheads (13) configured for placing the raised surface (14) on a fixed surface.

20. The method of claim 19, wherein the connector that joins the at least one internal part and the external tubular part is a longitudinal connector (17), where one of its ends joins the horizontal projection (22) of the base (7) of the at least one internal part (1) and the other end is attached to the lower edge of the side that does not have an inlet (23) of the external wall of the tubular body (10).

21. The method of claim 19, wherein the connector that joins the at least one internal part and the external tubular part, is a first transverse connector (24) that joins the two internal parts (1) of two contiguous reinforced pedestals (A), by means of second linear edges (25) located on the sides adjacent to the sides where the first linear edges (22) are.

22. The method according to claim 19, wherein the connector that joins the at least one internal part and the external tubular part is a second transverse connector (26) that joins the two external parts (9) of two contiguous reinforced pedestals (A), throughout the lower edges of its sides that do not have inlets (23).

23. The method according to claim 19, further comprising: applying at least one detachment mechanism (18) to easily separate the at least one internal part and the external tubular part from the connectors (17, 24 and 26).

24. The method according to claim 23, wherein the detachment mechanism (18) is applied at the junction points between the connectors (17, 24 and 26) and the edges (22, 25) of the base (7) of the internal parts (1), and/or the lower edge of the external wall of the tubular body (10) of the external parts (9).

25. The method according to claim 23, wherein the applied detachment mechanism (18) is a slit and/or a weakening.

26. The method according to claim 19, comprising: providing at least one fastening element (19) for objects in the connector that joins the at least one internal part and the external tubular part.

27. The method of claim 26, wherein the fastening element (19) is selected from the following group: rings, and staples.

* * * * *